US008917980B2

(12) United States Patent
Scully

(10) Patent No.: US 8,917,980 B2
(45) Date of Patent: Dec. 23, 2014

(54) SMOKE GENERATING ENTERTAINMENT SYSTEM

(75) Inventor: Nick Scully, Scamblesby (GB)

(73) Assignee: Martin Professional A/S, Aarhus N (DK)

( * ) Notice: Subject to any disclaimer, the term of this patent is extended or adjusted under 35 U.S.C. 154(b) by 506 days.

(21) Appl. No.: 13/054,339

(22) PCT Filed: Jul. 13, 2009

(86) PCT No.: PCT/DK2009/050175

§ 371 (c)(1), (2), (4) Date: Jan. 14, 2011

(87) PCT Pub. No.: WO2010/009733

PCT Pub. Date: Jan. 28, 2010

(65) Prior Publication Data

US 2011/0121092 A1 May 26, 2011

(30) Foreign Application Priority Data

Jul. 23, 2008 (DK) ..... 2008 01034

(51) Int. Cl.

| | |
|---|---|
| ***A01G 13/06*** | (2006.01) |
| ***A01M 13/00*** | (2006.01) |
| ***A01M 19/00*** | (2006.01) |
| ***A61B 16/00*** | (2006.01) |
| ***F22B 29/06*** | (2006.01) |
| ***F22B 35/06*** | (2006.01) |
| ***A63J 5/02*** | (2006.01) |

(52) U.S. Cl.

CPC ..... *A63J 5/025* (2013.01)
USPC ..... 392/397

(58) Field of Classification Search

USPC ..... 239/136, 137; 222/52, 63, 333
See application file for complete search history.

(56) References Cited

U.S. PATENT DOCUMENTS

| | | | | | |
|---|---|---|---|---|---|
| 3,242,098 | A | * | 3/1966 | Andrews | 422/305 |
| 3,855,148 | A | * | 12/1974 | Locher et al. | 239/77 |
| 3,861,890 | A | * | 1/1975 | Doncer et al. | 95/23 |
| 3,990,987 | A | * | 11/1976 | Rogers | 73/170.04 |
| 4,215,549 | A | * | 8/1980 | Daeschner | 60/606 |
| 4,326,119 | A | * | 4/1982 | Swiatosz | 392/397 |

(Continued)

FOREIGN PATENT DOCUMENTS

| | | | |
|---|---|---|---|
| GB | 640 266 | A | 7/1950 |
| GB | 1 039 729 | A | 8/1966 |
| GB | 2 315 683 | A | 2/1998 |

*Primary Examiner* — Len Tran
*Assistant Examiner* — Alexander M Valvis
(74) *Attorney, Agent, or Firm* — Robert Mlotkowski Safran & Cole, P.C.; David S. Safran

(57) ABSTRACT

An entertainment system (1019, 2) having a fluid system with a smoke generator (1007, 4), the smoke generator being supplied from at least one pump (1005, 8, 10) connected to at least one container for fluid (1003, 12, 14), which at least one pump (1005, 8, 10) is controlled by a controller (1009, 6), wherein the controller is adapted to perform a shutdown process upon malfunctioning of at least a part of the entertainment system. The shutdown process performs a purge of at least part of the fluid system. Furthermore, a method of operating the entertainment system (1001, 2), has the steps of performing a shutdown process upon malfunctioning of at least a part of the entertainment system, the shutdown process including the step of purging (2009, 3003*a*, 3003*b*) at least a part of said fluid system.

16 Claims, 7 Drawing Sheets

(56) References Cited

U.S. PATENT DOCUMENTS

| | | | | | |
|---|---|---|---|---|---|
| 4,343,719 | A | * | 8/1982 | Stevens et al. | 123/3 |
| 4,349,723 | A | * | 9/1982 | Swiatosz | 392/399 |
| 4,439,341 | A | * | 3/1984 | Swiatosz | 516/5 |
| 4,531,375 | A | * | 7/1985 | Zinsmeyer | 62/85 |
| 4,558,196 | A | * | 12/1985 | Babasade | 219/629 |
| 4,764,660 | A | * | 8/1988 | Swiatosz | 392/397 |
| 4,818,843 | A | * | 4/1989 | Swiatosz | 392/397 |
| 5,168,544 | A | * | 12/1992 | Kolasa | 392/396 |
| 5,367,603 | A | * | 11/1994 | Wenrich et al. | 392/394 |
| 5,835,678 | A | * | 11/1998 | Li et al. | 392/401 |
| 5,870,524 | A | * | 2/1999 | Swiatosz | 392/394 |
| 6,018,615 | A | * | 1/2000 | Loblick | 392/397 |
| 6,347,188 | B2 | * | 2/2002 | Roffey | 392/397 |
| 6,477,890 | B1 | * | 11/2002 | Hulsebus | 73/40.7 |
| 6,789,789 | B2 | * | 9/2004 | Randive et al. | 261/133 |
| 7,529,472 | B2 | * | 5/2009 | Lazzarini et al. | 392/387 |
| 7,578,225 | B2 | * | 8/2009 | Bosch et al. | 89/11 |

* cited by examiner

SMOKE GENERATING ENTERTAINMENT SYSTEM

BACKGROUND OF THE INVENTION

1. Field of the Invention

The present invention relates to an entertainment system comprising a fluid system comprising smoke generating means, said smoke generating means are supplied from at least one pump connected to at least one container for fluid, which at least one pump is controlled by control means. The present invention furthermore relates to a method for operating an entertainment system.

2. Description of Related Art

Atmospheric effects such as special effect smoke like fog and haze are now seen as a key element in the field of entertainment effects. The use of these atmospheric effects can be found throughout motion pictures and television productions, live theatre, concerts, at nightclubs and raves, amusement and theme parks and even in video arcades and similar venues and are used for creating special effects to make lighting and lighting effects visible and to create a specific sense of mood or atmosphere. If an individual is at an entertainment venue and beams of light are visible cutting across the room, then it is most likely that smoke or fog is being used. Theatrical smoke and fog are indispensable in creating visible mid-air laser effects to entertain audiences, and lighting designers therefore use a fine diffused haze when creating such effects.

Most smoke/fog/haze machines create the smoke/fog/haze by either vaporizing a water and glycol-based or glycerine-based fluid or by a mineral-oil-based fog via atomization. For glycol-based smoke/fog/haze, the fluid (fog juice) is injected into a heated block and evaporates quickly. The resulting pressure forces the vapour out of the exit. Upon coming into contact with cool outside air the vapour forms a fog. When shutting down a machine of this type, it is important to allow the machine to go through a shut-down process before removing the AC network power from the machine. Failure to do this leads to a progressive build-up of polymerised glycol in the vaporiser resulting in premature failure of the unit. The machines are often used in connection with concerts and road shows where the machines are packed and transported to a new location just as the concert or roads show ends. The machines are as a consequence typically unplugged from the power supply without being properly shut down. Another issue is the fact that the smoke/fog/haze machines eventually consume all fog juice in the container, which also could damage the smoke generator and other parts of the smoke machine, if the machine continues to run after all fog juice have been consumed.

Furthermore, the machines use a large amount of energy to vaporise the fluid and thus need a large power supply. Large concerts and shows very often comprise a large number of smoke/fog/haze machines, lighting and sound equipment, and the power supply needs to be shared between the different equipment. The power supply might therefore be limited and the smoke/fog/haze machines can as a consequence not be supplied with sufficient power to create the smoke/fog/haze effects.

U.S. Pat. No. 3,242,098 relates to a fog generator where the energy supply is generated by a burner, which burner evaporates water and fog chemical in tube forming a coil around the burning flame. The generated steam in the coil is relieved through an outlet to form fog.

SUMMARY OF THE INVENTION

It is the object of the invention to achieve a smoke generating entertainment system that solves the above-mentioned problems and improves the lifetime of the entertainment system.

The object of the invention can be fulfilled by a system as described in the preamble to claim 1, which system can be further modified by adapting the control means to perform a shutdown process upon malfunctioning of at least a part of said entertainment system, and in that said shutdown process performs a purge of at least a part of said fluid system. Hereby it is ensured that the entertainment system is properly shut down, if a malfunction occurs during use of the entertainment system, and that the fluid system is purged whereby progressive build-up of polymerised glycol in the smoke generator resulting in premature failure of the unit is prevented. A malfunction could for instance be interruption of power supply, consumption of the fluid in the container, failure of pumps or smoke generator etc. The shutdown process would thus prevent further damage of the entertainment system upon malfunctioning of one part of the entertainment system, and service expenses are thus decreased, as less damage to the machine occurs.

The control means are in another embodiment adapted to perform said shutdown upon interruption of power to said entertainment system, and at least a part of said entertainment system is power supplied by a battery during said shutdown process. Hereby it is ensured that the entertainment system is properly shut down in case the power supply is disconnected, as the entertainment system is capable of completing the shutdown process using power from the battery to purge the fluid system. The lifetime of machines that are unplugged from the power supply without being properly shut down is increased, as the entertainment system automatically performs a proper shutdown.

The entertainment system comprises in another embodiment a fluid monitor measuring fluid pressure of at least a part of said fluid system, and said control means are adapted to perform said shutdown process based on said measured fluid pressure. Hereby it is possible to automatically perform a proper shutdown of the entertainment system in case all the fluid in the container is consumed. The fluid monitor could for instance monitor the back pressure from the smoke generator, as this pressure would decrease in case the system runs out of fluid.

The entertainment system comprises in another embodiment a gas pump pumping gas through at least a part of said fluid system during said shutdown process. Hereby a gas could be used to purge the fluid system and thus remove fog/smoke/haze fluid leftovers which build-up of polymerised glycol in the smoke generator. Furthermore, such gas could dry the fluid system and thus prevent corrosion of the fluid system.

The entertainment system comprises in another embodiment a liquid pump pumping liquid through at least a part of said fluid system during said shutdown process. Hereby liquid could be used to purge the fluid system, and the liquid could resolve fog/smoke/haze fluid leftovers and thus remove them from the fluid system. The liquid could for instance be demineralised water, which would not leave any minerals in the fluid system.

The smoke generating means comprise in another embodiment a heating storage which heating storage comprises at least one first electric heater, which heating storage block comprises at least one flow channel which flow channel comprises a number of turns, which channel has a length that at least is longer than the longest side of the heating storage. By using a large metal block as heat storage it is possible to store energy for evaporating a fluid so that the power demand during operation will be reduced. Using the heating storage will lead to a situation where a power failure will not be able to stop the generation of smoke. If a system comprises an uninterruptible power supply (UPS) or if it is connected to batteries, operation will continue as long as there is power supply and as long as there is still sufficient heating stored in the heat storing means. The heating which is stored will probably last for several minutes and will probably be effective up to 40 minutes. The use of the heating storage block will also reduce the peak power consumption of the smoke generator, as the power consumption of the smoke generator will be more stable compared to the power consumption of previous smoke detectors which are generating steam by immediately heating the liquid.

The heating storage is in another embodiment formed of at least two sections which sections are fastened towards each other by fastening means. By producing the heating storage block in two sections a channel can be formed in only one of the two sections. This can lead to a situation where one of the sections comprises electrical heating and also comprises the channel at the top. The second section covering the channel can then be a relatively thick flat section where only the mass of the material is used for heat storage. The two sections have to be fastened towards each other. It is possible to screw the sections together but welding seems to be the preferred method.

A number of entertainment systems are in another embodiment operatively linked by communication means whereby the heating elements operate in time share mode depending on actual heating demand. Hereby it is possible to run several smoke generating entertainment systems simultaneously on the same power line without extending the capacity of the power line as the entertainment systems only consume power when needed.

In another embodiment at least one of said pumps is a diaphragm pump used for pumping liquids. A diaphragm pump is very robust compared to conventionally used piston pumps and the lifetime of the entertainment system is thus increased.

The internal system components are in another embodiment powered from a 12V source to allow software controlled shutdown irrespective of the shutdown source or the presence of AC network power.

The present invention relates also to a method for operating an entertainment system comprising a fluid system comprising smoke generating means, where said smoke generating means are supplied from at least one pump connected to at least one container for fluid, said method comprises the steps of performing a shutdown process upon malfunctioning of at least a part of said entertainment system, and said shutdown process comprises the step of purging at least a part of said fluid system. Hereby the same advantages as described above are achieved.

The shutdown process is in another embodiment performed upon interruption of power to said entertainment system and said shutdown process comprises the step of power supplying at least a part of said entertainment system by a battery. Hereby the same advantages as described above are achieved.

The method comprises in another embodiment the step of measuring fluid pressure of at least a part of said fluid system and the step of performing said shutdown process based on said measured fluid pressure. Hereby the same advantages as described above are achieved.

The shutdown process comprises in another embodiment the step of pumping gas through at least a part of said fluid system. Hereby the same advantages as described above are achieved.

The shutdown process comprises in another embodiment the step of pumping liquid gas through at least a part of said fluid system. Hereby the same advantages as described above are achieved.

DETAILED DESCRIPTION OF THE INVENTION

Figure 1:
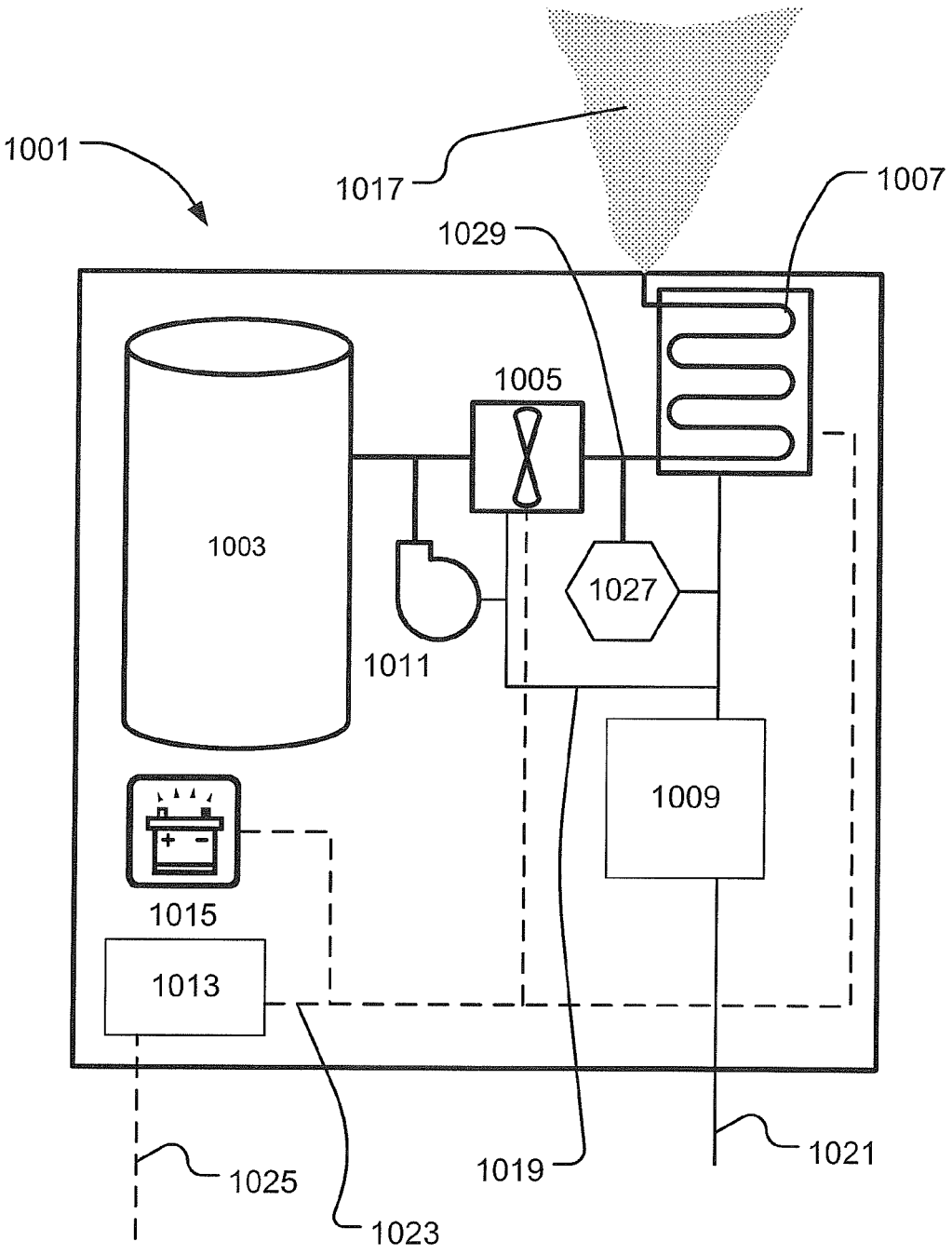
FIG. 1 illustrates an entertainment system according to the present invention.

FIG. 1 illustrates a smoke generating entertainment system 1001 comprising a container 1003, a liquid pump 1005, smoke generating means 1007, a controller 1009, an air pump 1011, a power module 1013 and a battery 1015. The container comprises smoke/fog/haze liquid, and the liquid pump 1005 pumps the smoke/fog/haze liquid into the smoke generating means 1007, which generates smoke/fog/haze 1017 by atomizing or vaporizing the smoke/fog/haze liquid as known in the art. The controller is adapted to control the liquid pump 1005, the air pump 1011 and the smoke generator through communication line 1019 for instance in order to activate/deactivate the pumps, increase/decrease liquid flow or regulate the smoke generating means etc. The communication line could, for instance, be carried out as a data bus, a single wire bus or any communication line known in the art of communication. The controller could for instance be a microcontroller, computer, microprocessor, printed circuit board or the like. The controller can in this embodiment control the entertainment system based on an external communication signal 1021, e.g., based on a DMX protocol or the like, but the entertainment system can also be performed based on a pre-programmed pattern stored in the control unit (1009). The system components are supplied with power through an internal power line 1023 which during normal running conditions receives power through the power module 1013, which is connected to an external power source e.g., an AC source. The internal power supply could in one embodiment be based on a 12 V DC supply and the power module thus converts the external power supply into 12 V DC. The internal power supply system could however in other embodiments be based on other voltages and also on AC. The system components would be power supplied by the battery 1015 in case the connection 1025 to the external power source fails or the power module fails. The system could be adapted to automatic switching on of the battery backup as soon as the external power supply is disconnected and to be adapted to recharge the battery when the power supply is connected. The controller is adapted to start a shut-down process (illustrated in FIGS. 2 and 3) in case of malfunctioning of at least a part of the entertainment system, e.g., interruption of external power supply, consumption of smoke liquid and failure of the fluid system or pumps or other components. The controller then deactivates the liquid pump 1005 and activates the air pump to purge the liquid pump and smoke generation means during the shutdown process. This prevents progressive build-up of polymerized glycol in the vaporizer resulting in premature failure of the system, e.g., in case the system is disconnected from the external power supply and stored.

The entertainment system comprises furthermore a fluid monitoring system 1027, which comprises means 1029 for measuring the back pressure from the smoke generator. Introducing fluid to the smoke generator causes a measurable increase in the system pressure and can thus be used to indirectly measure the absence of fluid and indicate a malfunctioning of the system and thus activate the shutdown process. The fluid monitoring system 1027 can therefore send a shutdown signal to the controller when it measures a decrease in the back pressure from the smoke generator or when the back pressure has fallen to a lower threshold value. The controller could then start the shutdown process as described below.

Figure 2:
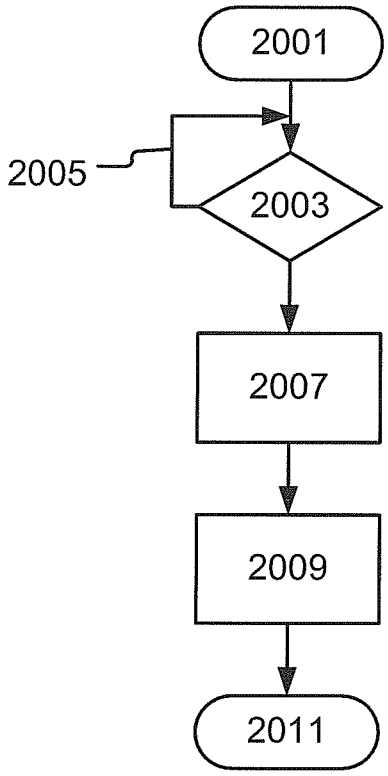
FIG. 2 illustrates a shutdown process for the entertainment system.

FIG. 2 illustrates a flow diagram of the shut-down process performed by the control means when a malfunction, such as interruption of external/network power, consumption of fog fluid, pump failure etc., occurs. The control unit initializes (2001) during start up the shutdown process and a malfunction test (2003) is configured to run continuously or at regular intervals during use of the entertainment system. The malfunction test (2003) tests if the entertainment system runs properly, e.g., if it is properly connected to an external/network power supply, if external/network power fails. The malfunction test furthermore tests whether or not the smoke liquid has been consumed, the status of the pumps etc. Nothing is done (2005) as long as the entertainment system is running properly. On the other hand, the liquid pump pumping liquid into the smoke generator is deactivated (2007) when a malfunction is registered. Thereafter a purging process (2009) cleaning the fluid system is started, e.g., by activating a gas pump purging gas through the fluid system and thus cleaning the smoke generator. The entertainment system is finally turned off (2011) once the cleaning process is completed.

Figure 3:
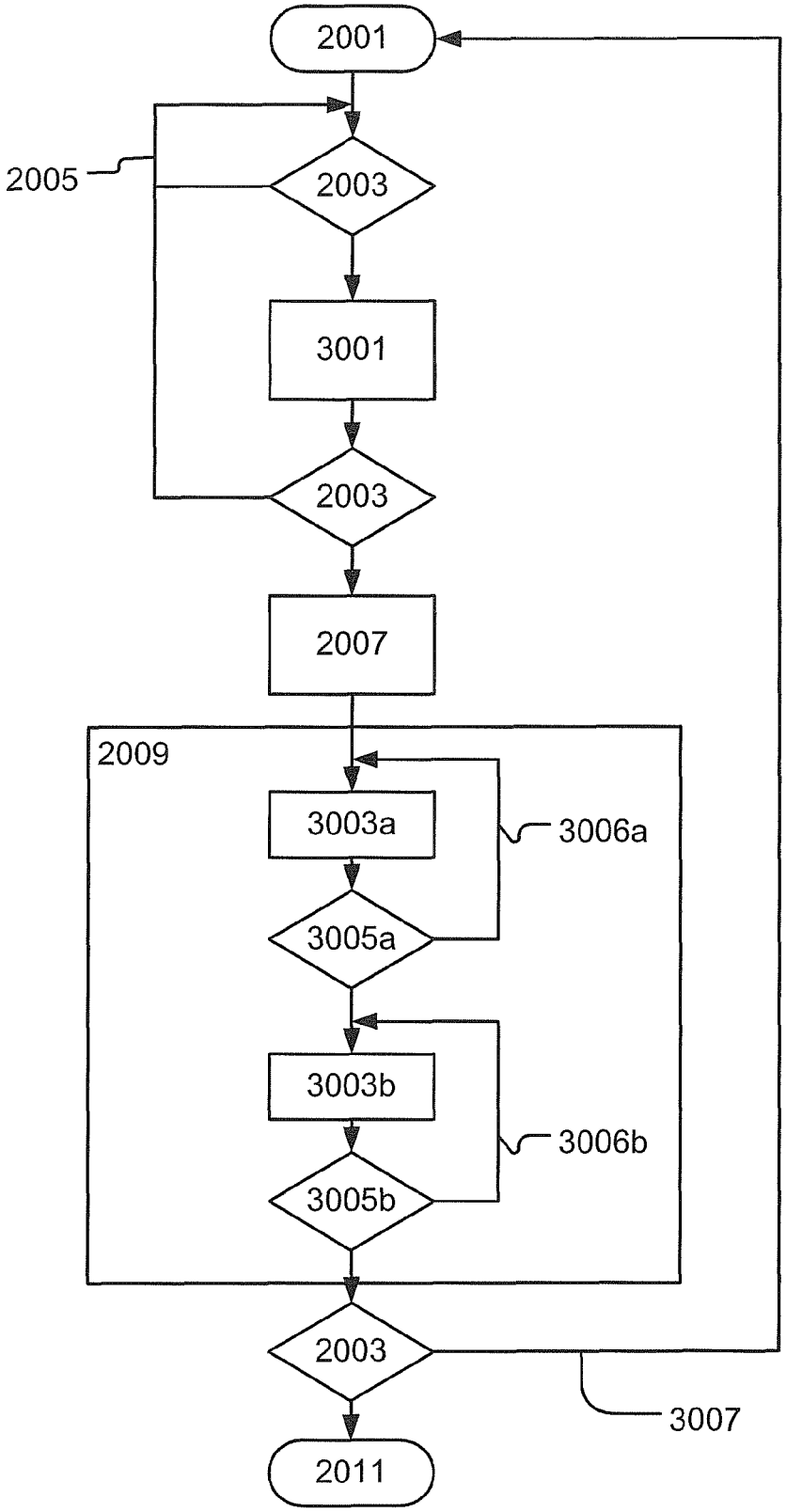
FIG. 3 illustrates another shutdown process for the entertainment system.

FIG. 3 illustrates another embodiment of the shutdown process. The malfunction test (2003) is in this embodiment performed twice separated by a time delay (3001) in order to verify that the registered malfunction truly occurred. The time delay could be any period of time, e.g., defining the period of time that the malfunction should have occurred before the shutdown process is continued.

The cleaning process (2009) comprises in this embodiment the step of running a water pump (3003*a*) (see, FIG. 4 for illustration of water pump) purging water through the smoke generator. The water pump could for instance run for a predetermined period of time until a predetermined amount of water has been purged through the smoke generator or could also be performed a number of times to ensure that all fog/haze/smoke liquid is removed from the smoke generator. Step (3005*a*) therefore represents a test procedure testing the conditions that needs to be fulfilled before moving on to the next step in the shutdown process. The shutdown process thus continues in test loop (3006*a*) until the test condition(s) is/are fulfilled. Similar steps (3003*b*), (3005*b*) and (3006*b*) are performed using an air pump pumping air or another kind of cleaning gas through the smoke generator to dry and blow dirt and liquid leftovers out of the smoke generator. This embodiment further comprises a final malfunction test that tests if the malfunction has be repaired, e.g., if the external/network power supply has been re-established or smoke liquid has been filled into the container and cancels (3007) the shutdown process if this is true. Otherwise the entertainment system is turned off (2011).

Figure 4:
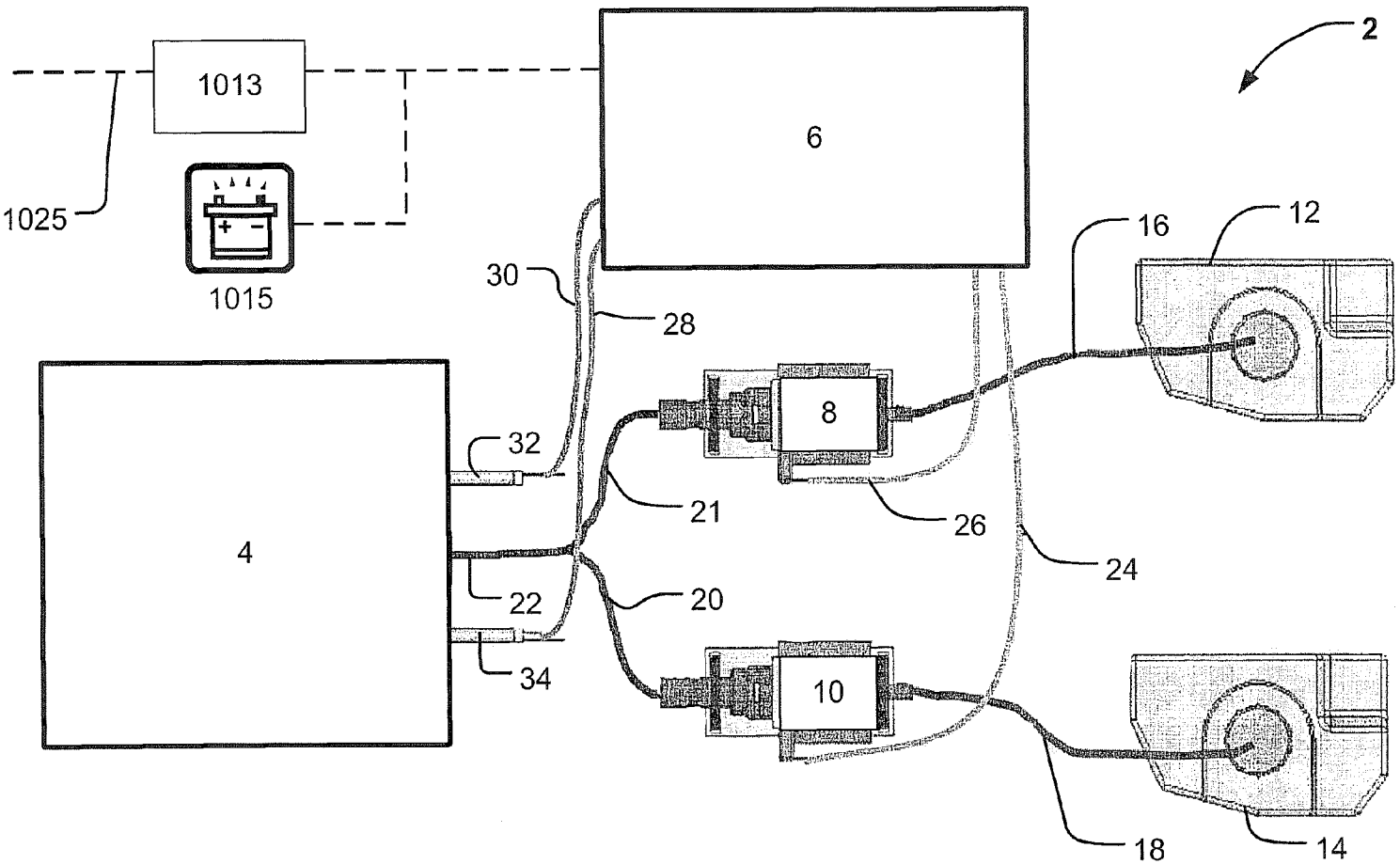
FIG. 4 illustrates another entertainment system according to the present invention.

FIG. 4 shows another embodiment of a smoke generating entertainment system 2. The entertainment system comprises a heat storage 4 as described below and controlling means embodied as a printed circuit board 6. The system furthermore comprises a liquid system comprising a first water pump 8 and a second glycol pump 10. The water is pumped from water storage 12, and the glycol is pumped from glycol storage 14. A water line 16 is connected between the water storage 12 and the first water pump 8. Furthermore, a liquid line 18 is connected between the glycol storage 14 and the glycol pump 10. The pump 8 has an outlet 21, and the pump 10 has an outlet 20. The outlets 20 and 21 are combined in a common liquid line 22, which is connected to the heat storage 4. The PCB 6 has a first control line 24 leading towards the pump 10 and a second control line 26 connected to the pump 8. Furthermore, the PCB has electric connections 28 and 30 leading to the heating element placed in the heat storage where this heating element has terminals 32, 34.

In a first manner of operation, the PCB 6 supplies electrical energy through the lines 28 and 30 through the input terminals 32 and 34 to the heating element placed in the heat exchanger. Thereby, the heat storage is heated to a sufficient high temperature for generating smoke. Temperature regulations could be preferred so that the heat exchanger is regulated to a controlled maximum temperature.

The pump 8, 10 will then start operating and pump water and glycol through the lines 16 and 18 and deliver liquids under pressure through the lines 20, 21 and 22 to the heat storage 4 where the liquid is evaporated. The evaporated liquid is then sent through an outlet (not shown) whereby the smoke/fog/haze effects are generated. It is to be understood that the power consumption in the heating element placed in the heat storage 4 is relatively limited. Therefore, operation of the heat exchanger can continue even if the lines 28, 30 are not conducting any power towards the heating element through terminal 32, 34. If only the pumps 8, 10 are operating smoke will be generated by the heat stored in the heat storage 4. Thereby, the pumps will be able to operate, if they are connected by a battery supply or by an uninterrupted power supply.

The entertainment system can comprise at least one pump 8, 10. The duration of operation of the pump is controllable by PCB 6 to regulate the density of the smoke screen. One way of controlling the density of the smoke is to control the duration of the pump 8, 10. The pump could be controlled by pulse with modulation (PWM). By PWM modulation is achieved an effective regulation where the smoke formed continues. In a smoke generator using a heating storage it is not possible to regulate the heating element. Therefore an effective control of the pump is preferred.

The PCB entertainment system is like the entertainment system described in FIG. 1 powered by an external power supply 1025 through a power module 1013, and a battery is adapted to provide power upon disconnection of the external power supply 1025 such that the PCB can perform a shutdown process as described above.

Figure 5B:
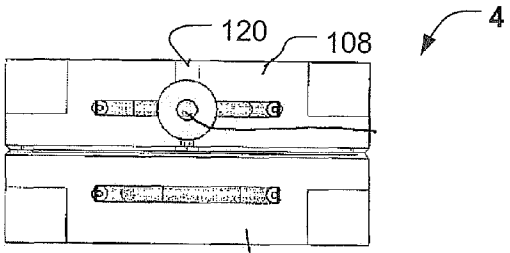
FIGS. 5*a*, 5*b*, 5*c* and 5*d* illustrate a first embodiment of a heating storage block.
Figure 5D:
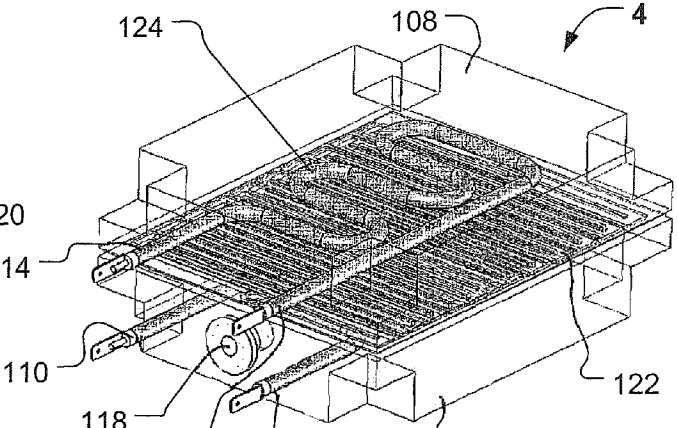
Figure 5A:
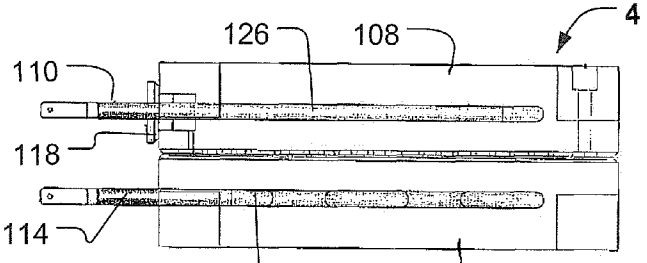
Figure 5C:
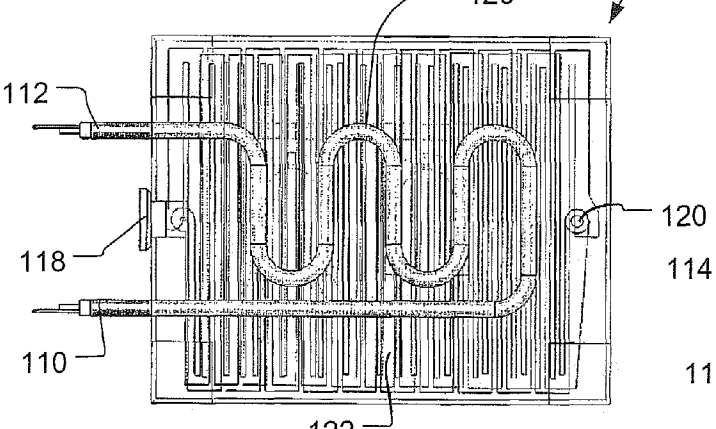

FIGS. 5*a*, 5*b*, 5*c*, 5*c* show respectively a side, front, top and perspective view of a heat storage 4 used in the entertainment system of FIG. 4. The heat storage 4 comprises a lower section 106 and an upper section 108. The lower section 106 comprises an electric heating element 124 which comprises terminals 114, 116. The upper part 108 of the heat storage comprises a second heating element 126 which has inlet terminals 110, 112. The heating storage 4 comprises an inlet 118, which is connected to a channel 122, which channel runs from the inlet 118 to the outlet 120.

During operation, liquid is pumped to the inlet 118 into the channel 122 where this liquid will evaporate before it leaves the channel at the outlet 120.

Figure 6A:
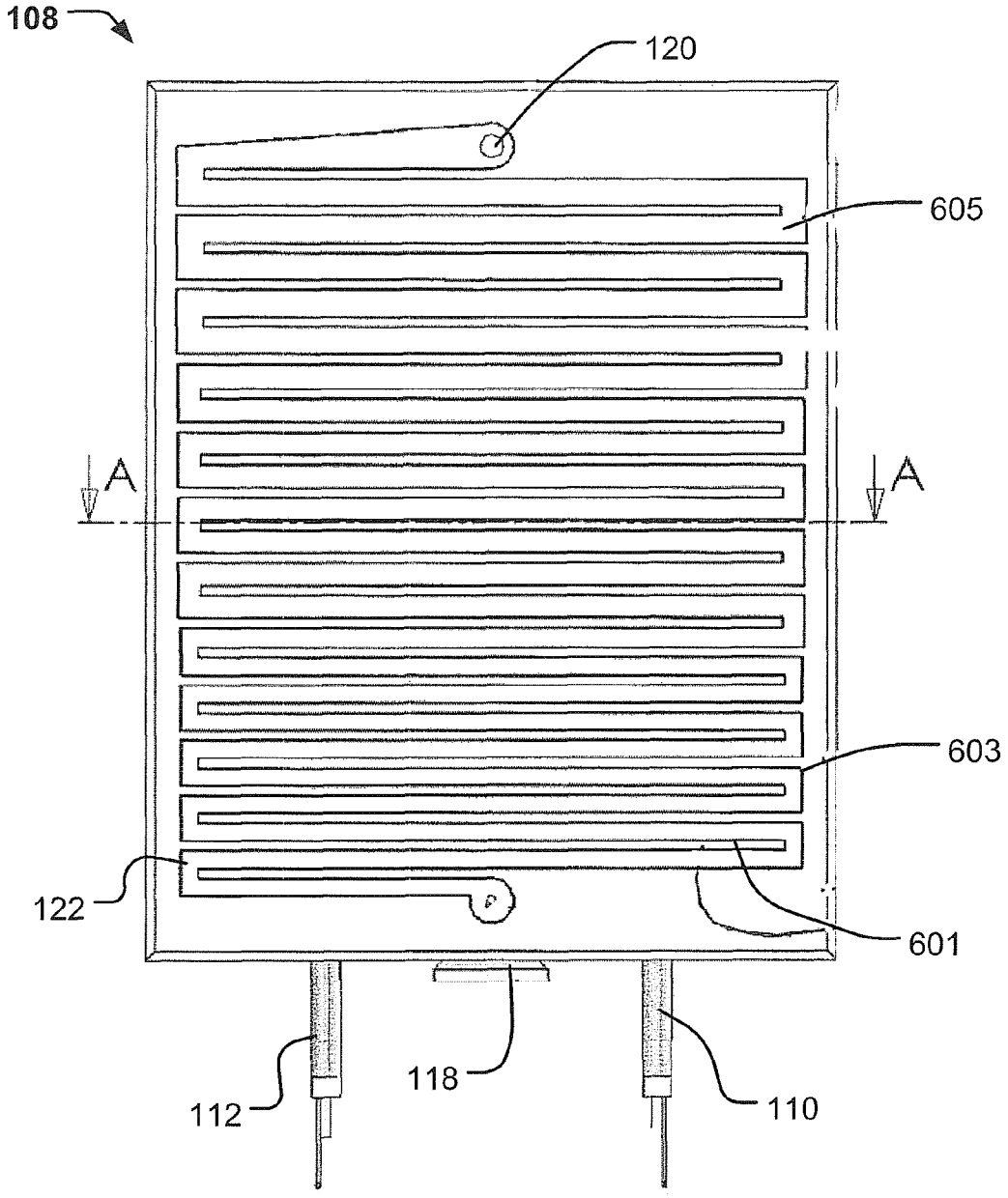
FIGS. 6*a* and 6*b* illustrate a sectional view of a possible embodiment for a heating block.
Figure 6B:
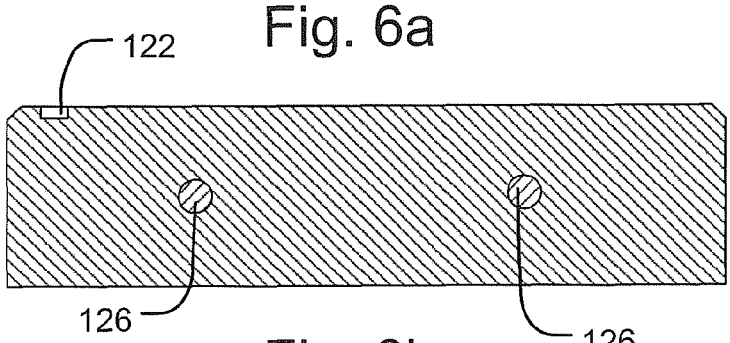

FIG. 6*a* shows the upper section 108 of a heat storage block 4 illustrated in FIG. 5, and FIG. 6*b* illustrates the cross section taken along line A-A. The upper part 108 of the heat storage block 4 comprises a first terminal 110 and a second terminal 112 connected to a heating element 126 placed in the block 108. The heating block 108 comprises a liquid inlet 118 which is connected to a fluid channel 122. The channel 122 is limited by walls 601, and the channels 122 have edges 603. Towards the outlet the channel 122 is increased into a channel 605, which channel 605 has a bigger cross-sectional area. The channel 605 is connected to an outlet 120.

During operation, the upper section 108 will be covered by the second part of the heating storage block. Fluid is sent through the inlet 118 into the channel 122 in which channel the liquid is heated and the liquid starts boiling and thereby evaporates. Along the channel 122, more and more of the liquid will be converted into steam, and at the outlet 120 the liquid content is supposed to be very small. The liquid is expanding very much by the evaporation, thus the volume of the channel increases over its whole length. This increasing channel cross-sectional area results in a natural reduction of a backflow.

Figure 7A:
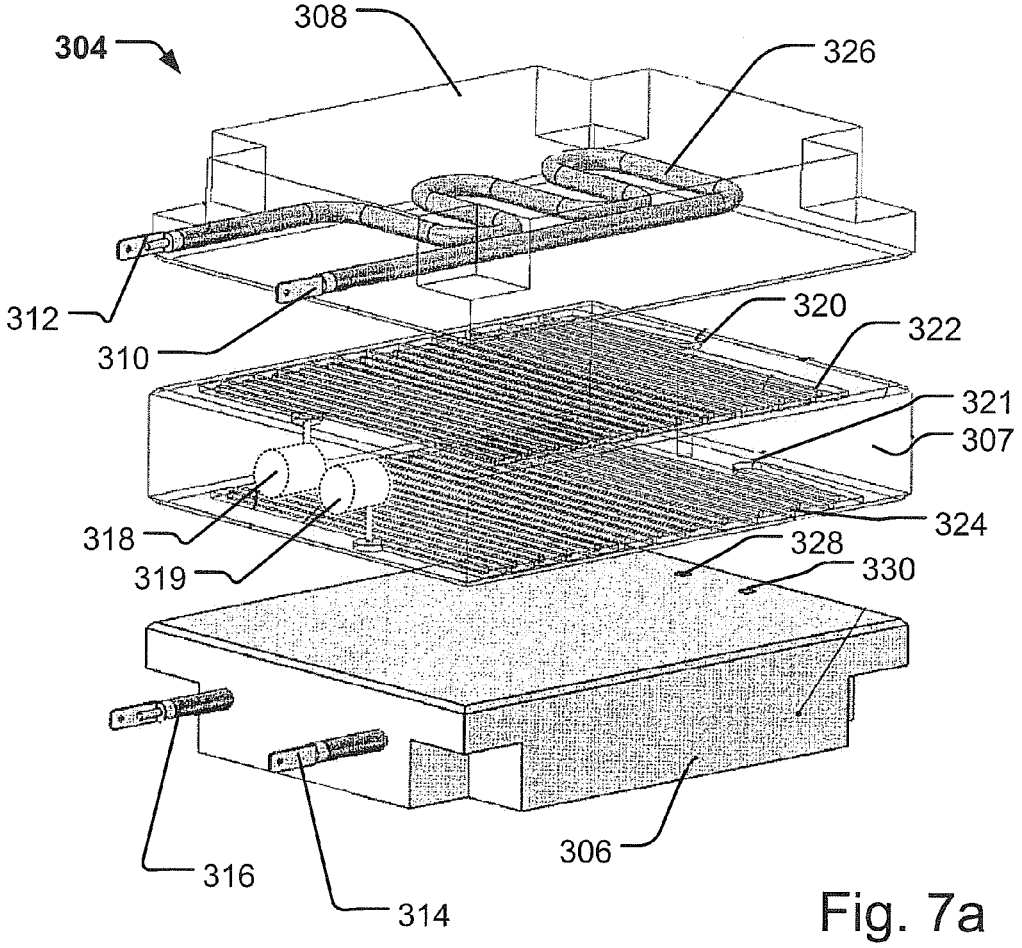
FIGS. 7*a* and 7*b* illustrate a second embodiment for the heating block.
Figure 7B:
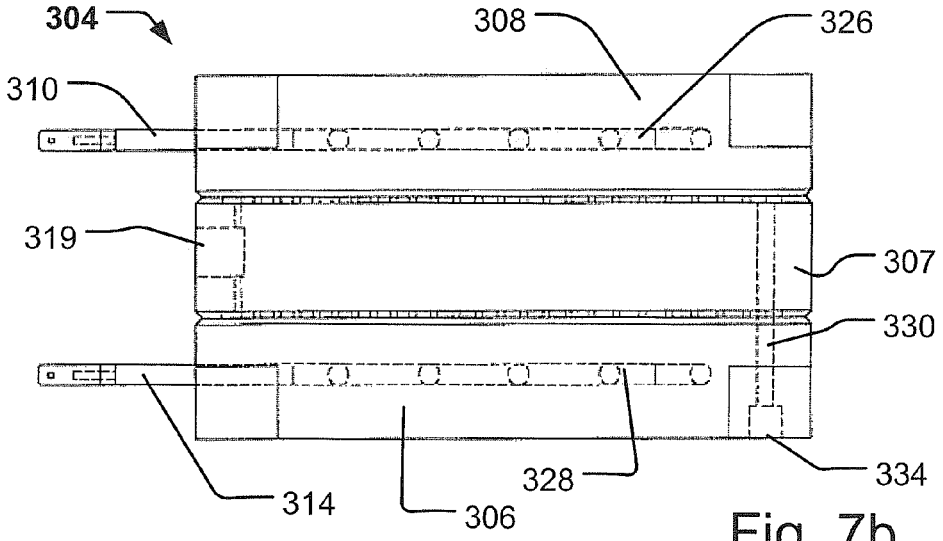

FIGS. 7*a* and 7*b* illustrate respectively an exploded view and a side view of an alternative embodiment for a heat block 304. Furthermore, the figures illustrate the heating storage block 304 comprising an upper section 308 and a lower section 306. Between these two sections are placed a middle section 307. The upper section 308 comprises an electric heating element 326 embedded in the material, which electric heating element has a first terminal 310 and a second terminal 312. Furthermore, the lower part 306 has an electrical heating element 328 embedded in the material, and this heating element comprises electrical terminals 314 and 316. The middle section 307 comprises inlets 318 and 319. Furthermore, the middle section comprises channels at the upper and lower side. These channels have the numbers 322, 324. The channels end at an upper outlet 320 and a lower outlet 321, which via two vertical channels 328, 330 are connected to two outlets (only one 334 illustrated in FIG. 7*b*) at the bottom of the lower section 306.

By using three-layer heat storage, the storage capacity is increased, and because there are two channels formed in the middle section the capacity of smoke generation is increased. Furthermore, the total mass in relation to the previously described embodiments is increased. This also means in this embodiment that there is sufficient heat stored in the heat storage means 304 to let the smoke generator operate without power supply for a longer period which is supposed to be as long as 40 minutes.

For both embodiments, it is important that the heat storage has relatively high heat conductivity to conduct heat towards the channels during operation. Therefore, the heating storage is probably produced of metal. One possible metal for this purpose is an aluminum alloy. Other metals or other alloys could be used depending on the heat storage capacity.

What is claimed is:

1. An entertainment system (1019, 2) comprising a fluid system comprises smoke generating means (1007, 4), for directing enterainment smoke into an ambient area, said smoke generating means comprising at least one heat exchanger having at least one flow channel, said at least one flow channel being supplied with smoke liquid from at least one pump (1005, 8, 10) connected to at least one container of the smoke fluid (1003, 12, 14), which the at least one pump (1005, 8, 10) is controlled by control means (1009, 6), wherein a purging system having a pump that is connected to said at least one flow channel of the at least one heat exchanger, and wherein said control means are configured to automatically detect malfunctioning of at least a part of said entertainment system to perform a shutdown process in response to detection of said malfunctioning of at least a part of said entertainment system, said control means being connected to the purging system for causing at least a part of said at least one flow channel of the at least one heat exchanger is purged by said purging system pumping a fluid through the at least one heat exchanger during the shutdown process.

2. An entertainment system according to claim 1, wherein said control means (1009, 6) are adapted to perform said shutdown upon interruption of power (1025) to said entertainment system and in that at least a part of said entertainment system is power supplied by a battery (1015) during said shutdown process.

3. An entertainment system according to claim 1, wherein said entertainment system furthermore comprises a fluid monitor (1027) measuring fluid pressure of at least a part of said fluid system and in that said control means (1009, 6) are adapted to perform said shutdown process based on said measured fluid pressure.

4. An entertainment system according to claim 1, wherein said purging system comprises a gas pump (1011) pumping gas through at least a part of said fluid system during said shutdown process.

5. An entertainment system according to claim 1, wherein said purging system comprises a liquid pump (1005, 8, 10) pumping liquid through at least a part of said fluid system during said shutdown process.

6. An entertainment system according to claim 1, wherein said smoke generating means comprise a heating storage (4, 304), which heating storage (4, 304) comprises at least one first electric heater, which heating storage block comprises at least one flow channel (122, 605, 322, 324) which flow channel (122, 605, 322, 324) comprises a number of turns, which channel (122, 605, 322, 324) has a length that at least is longer than the longest side of the heating storage (4,304).

7. An entertainment system according to claim 6 wherein said heating storage (4, 304) is formed of at least two sections (106,108, 306,307,308) which sections (106,108, 306,307, 308) are fastened towards each other by fastening means.

8. An entertainment system according to claim 6, wherein a number of entertainment systems are operatively linked by communication means, whereby the heating elements are operating in time share mode depending on the actual heating demand.

9. An entertainment system according to claim 6, wherein the rate of operation of said at least one pump is controllable by said control means dependent upon the temperature of the heat storing block.

10. An entertainment system according to claim 1, wherein at least one of said at least one pump is a diaphragm pump used for pumping liquids.

11. An entertainment system according to claim 1, wherein all internal systems components are powered from an internal power supply to allow software controlled shutdown irrespective of shutdown of external power source or the presence of AC network power.

12. Method of operating an entertainment system (1001, 2), comprising the steps of:

supplying at least one flow channel of at least one heat exchanger of a smoke generating means (1007, 4) from at least one pump that is (1005, 8, 10) connected to at least one container of smoke fluid (1003,12,14), directing entertainment smoke produced by said smoke generating means into the ambient area ,and automatically performing a shutdown process upon detection by a control system of malfunctioning of at least a part of said entertainment system, and wherein said shutdown process comprises the step of purging (2009, 3003a, 3003b) at least a part of said at least one flow channel by pumping a fluid through the at least one heat exchanger during the shutdown process.

13. Method of operating an entertainment system according to claim 12 wherein said shutdown process is performed upon interruption of power (1025) to said entertainment system, and said shutdown process comprises the step of supplying power to at least a part of said entertainment system by a battery (1015).

14. Method of operating an entertainment system according to claim 12, wherein said method comprises the step of measuring fluid pressure of at least a part of said fluid system and by performing said shutdown process based on said measured fluid pressure.

15. Method of operating an entertainment system according to claim 12, wherein said shutdown process comprises the step of pumping gas (3003*b*) through at least a part of said at least one flow channel.

16. Method of operating an entertainment system according to claim 12, wherein said shutdown process comprises the step of pumping liquid (3003*a*) through at least a part of said at least one flow channel.

* * * * *